US008191517B2

(12) United States Patent
Mustafa

(10) Patent No.: US 8,191,517 B2
(45) Date of Patent: Jun. 5, 2012

(54) INTERNAL COMBUSTION ENGINE WITH DUAL-CHAMBER CYLINDER

(76) Inventor: Rez Mustafa, Covina, CA (US)

( * ) Notice: Subject to any disclaimer, the term of this patent is extended or adjusted under 35 U.S.C. 154(b) by 833 days.

(21) Appl. No.: 12/238,203

(22) Filed: Sep. 25, 2008

(65) Prior Publication Data

US 2010/0071640 A1 Mar. 25, 2010

(51) Int. Cl.
*F02B 25/00* (2006.01)

(52) U.S. Cl. ..... 123/70 R; 123/559.1; 123/196 R

(58) Field of Classification Search ..... 123/197.1, 123/54.3, 55.3, 74 R, 6 VD, 318, 316, 70 R, 123/196 R, 197.4
See application file for complete search history.

(56) References Cited

U.S. PATENT DOCUMENTS

| | | | | |
|---|---|---|---|---|
| 385,226 | A | 6/1888 | Barden | |
| 1,045,505 | A | 11/1912 | Brauer | |
| 1,122,972 | A | 12/1914 | Maye | |
| 1,374,164 | A | 4/1921 | Nordwick | |
| 1,419,693 | A | 6/1922 | Schultz | |
| 1,528,164 | A | 3/1925 | Nordwick | |
| 1,654,378 | A | 12/1927 | Marchetti | |
| 1,828,060 | A | 10/1931 | Michael | |
| 3,517,652 | A | 6/1970 | Albertson | |
| 3,584,610 | A | 6/1971 | Porter | |
| 3,820,337 | A | 6/1974 | Martin | |
| 3,842,812 | A * | 10/1974 | Marcus | 123/318 |
| 4,003,351 | A | 1/1977 | Gunther | |
| 4,013,048 | A | 3/1977 | Reitz | |
| 4,459,945 | A | 7/1984 | Chatfield | |
| 4,480,599 | A | 11/1984 | Allais | |
| 4,545,336 | A | 10/1985 | Waide | |
| 4,945,725 | A | 8/1990 | Carmein | |
| 5,791,303 | A | 8/1998 | Skripov | |
| 6,253,717 | B1 * | 7/2001 | Doyle | 123/44 D |
| 6,976,467 | B2 | 12/2005 | Fantuzzi | |
| 7,104,227 | B2 * | 9/2006 | Roberts | 123/55.7 |
| 7,121,236 | B2 | 10/2006 | Scuderi | |
| 2001/0017122 | A1 | 8/2001 | Fantuzzi | |
| 2004/0261732 | A1 | 12/2004 | Fantuzzi | |
| 2005/0095770 | A1 | 10/2005 | Major | |
| 2008/0121196 | A1 * | 5/2008 | Fantuzzi | 123/55.2 |
| 2008/0141855 | A1 * | 6/2008 | Fisher | 92/140 |

FOREIGN PATENT DOCUMENTS

| | | |
|---|---|---|
| WO | W098/49434 | 11/1998 |

* cited by examiner

*Primary Examiner* — Noah Kamen
*Assistant Examiner* — Long T Tran
(74) *Attorney, Agent, or Firm* — Kirk A. Buhler; Buhler & Associates

(57) ABSTRACT

Improvements in a gas powered engine. Said improvements include use of a piston with a fixed piston arm that extends through a seal in the lower portion of the cylinder. In this proposal of four-stroke engine, the down chamber is used as supercharger for the upper chamber cylinder engine. In this proposed two-stroke engine the down chamber is used as a compressor chamber and the compressed air passes to the upper chamber. The piston arm operates on an elliptical crank that drives the output shaft. Valves that move air and exhaust into and out of the pistons are lifted by a cam located on the crank. A unique oil injector passes oil between the rings when the piston is in at the bottom of the stroke.

18 Claims, 15 Drawing Sheets

FRICTION POWER (kW)
15
10
5
0
1500 2000 2500 3000 3500 4000 4500
ENGINE SPEED, rpm
PUMPING POWER
VALVE GEAR POWER
PISTON RING FRICTION
PISTON AND CONNECTING ROD FRICTION
OIL PIMPING
CRANKSHAFT FRICTION
TOTAL LOSSES
FRICTION LOSSES

INTERNAL COMBUSTION ENGINE WITH DUAL-CHAMBER CYLINDER

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in an internal combustion engine. More particularly each cylinder is divided into two chambers by the piston where the upper chamber is used for combustion and the lower chamber is used for air pumping and initial compression.

When the internal combustion engine is used as a two-stroke engine the engine size can be reduced by up to 50% of an existing four-stroke engine.

When the internal combustion engine is used as a four-stroke engine the engine will be similarly sized to an existing four-stroke engine except the chamber under the piston will work as a supercharger and improve efficiency.

2. Description of Related Art Including Information Disclosed Under 37 CFR 1.97 and 1.98

Numerous patents have been issued on piston driven engines. The majority of these engines use pistons that move up and down in a cylinder. The piston is connected to a crank shaft and the piston pivots on a wrist pin connected to the piston connecting rod. The side-to-side motion of the piston rod eliminates the potential for a sealing surface under the piston. The design of an engine with piston rods that remain in a fixed orientation to the piston allow for a seal to exist under the piston and this area can be used as a pump to increase the volume of air being pushed into the top of the piston to turbo-charge the amount of air within the cylinder without use of a conventional turbo charger driven from the exhaust or the output shaft of the engine. Several products and patents have been issued that use piston rods that exist in fixed orientation to the piston. Exemplary examples of patents covering these products are disclosed herein.

There is a large amount of energy that is lost due to aerodynamic drag from the piston pushing air under a piston as it moves. In existing engines that use only the top of the piston energy is wasted from the aerodynamic drag. In a dual chamber cylinder there is no aerodynamic drag.

U.S. Pat. No. 3,584,610 issued Jun. 15, 1971 to Kilburn I. Porter discloses a radial internal combustion engine with pairs of diametrically opposed cylinders. While the piston arms exist in a fixed orientation to the pistons the volume under the pistons is not used to pump air into the intake stroke of the engine.

U.S. Pat. No. 4,459,945 issued Jul. 17, 1984 to Glen F. Chatfield discloses a cam controlled reciprocating piston device. One or opposing two or four pistons operates from special cams or yokes that replace the crankpins and connecting rods. While this patent discloses piston arms that are fixed to the pistons there also is no disclosure for using the area under each piston to move air into the intake stroke of the piston.

U.S. Pat. No. 4,480,599 issued Nov. 6, 1984 to Egidio Allais discloses a free-piston engine with operatively independent cam. The pistons work on opposite sides of the cam to balance the motion of the pistons. Followers on the cam move the pistons in the cylinders. The reciprocating motion of the pistons and connecting rod moves a ferric mass through a coil to generate electricity as opposed to rotary motion. The movement of air under the pistons also is not used to push air into the cylinders in the intake stroke.

U.S. Pat. No. 6,976,467 issued Dec. 20, 2005 and published application US2001/0017122 published Aug. 30, 2001, both to Luciano Fantuzzi disclose an internal combustion engine with reciprocating action. The pistons are fixed to the piston rods, and the piston rods move on a guiding cam that is connected to the output shaft. These inventions use the piston was as a guide for reciprocating action and thereby produce pressure on the cylinder walls. The dual chamber design uses piston wall and a guided tube in the bottom of the lower chamber as guides for the piston in the reciprocating action. Neither of these two documents discloses using the lower chamber as a supercharger.

What is needed is an engine where the underside of the piston is used to compress the air and work as a supercharger for the upper chamber cylinder. This application discloses and provides that solution.

BRIEF SUMMARY OF THE INVENTION

It is an object of the engine with dual chamber cylinders to utilize the underside of a piston to act as a supercharger or compressor for the engine use or other uses.

It is an object of the engine with dual chamber cylinders to use a guided tube in the bottom of the cylinder and an ellipse shaft to convert reciprocating rectilinear motion into rotational motion.

It is an object of the engine with dual chamber cylinders to use the upper chamber as a four-stroke engine and the lower chambers as a compressor or supercharger.

It is an object of the engine with dual chamber cylinders to use a split cycle or two-stroke engine by using the upper chamber as combustion/exhaust and the lower portion of the cylinder as an air/compressor. This design can result in a reduction of the engine size by up to 50%.

It is an object of the engine with dual chamber cylinders to eliminate friction that is created by the piston rocking and being pushed and pulled side-to-side with the piston arm. The side-to-side force is eliminated because the piston is pushed and pulled linearly within the cylinder thereby eliminating the side-to-side rotation and friction.

It is an object of the engine with dual chamber cylinders to eliminate the aerodynamic forces and drag from under the piston.

It is an object of the engine with dual chamber cylinders that the area under the chamber works as a shock absorber for the area above the piston thereby making the engine operate quieter.

It is an object of the engine with dual chamber cylinders to be used for an airplane engine because the engine can be lighter in weight and higher in efficiency.

It is an object of the engine with dual chamber cylinders to eliminate the crankshaft, camshaft, cam sprocket, timing belt, timing belt tensioner and outside supercharger or turbocharger. The elimination of the identified components can reduce the space, weight and cost and energy consumption.

It is an object of the engine with dual chamber cylinders to save energy of the dual chamber verses existing four-stroke engine because the engine is lighter, lower friction, no side forces in the piston, fewer parts and no aerodynamic drag from under the piston as it moves within the cylinder.

It is still another object of the engine/compressor with dual chamber cylinders to use the engine/compressor as a compressor, pump for other function by using the motor to turn the elliptical shaft.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 3:
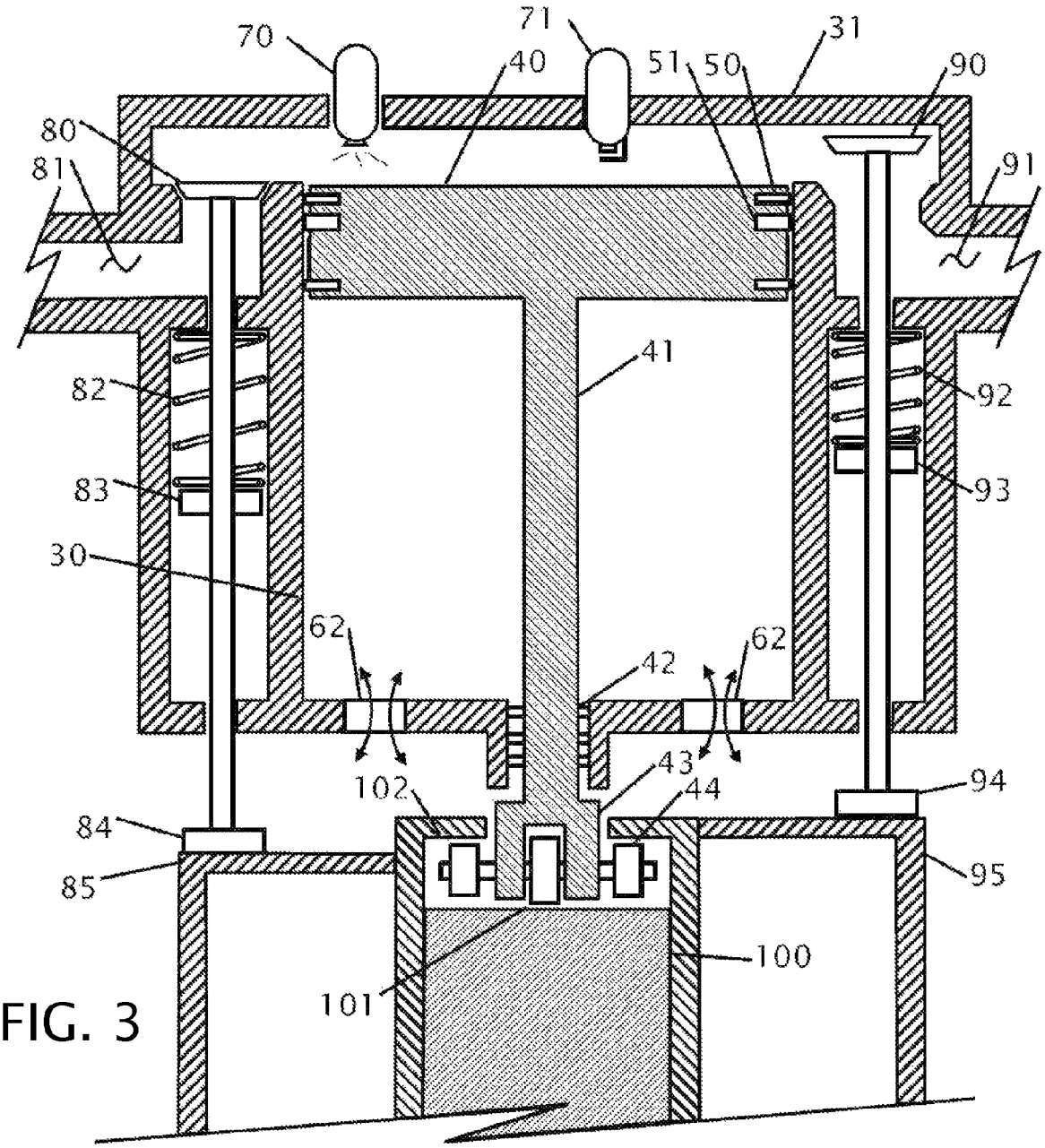

FIG. 3. Shows a cut-away view of the one chamber cylinder Type III.

Figure 4:
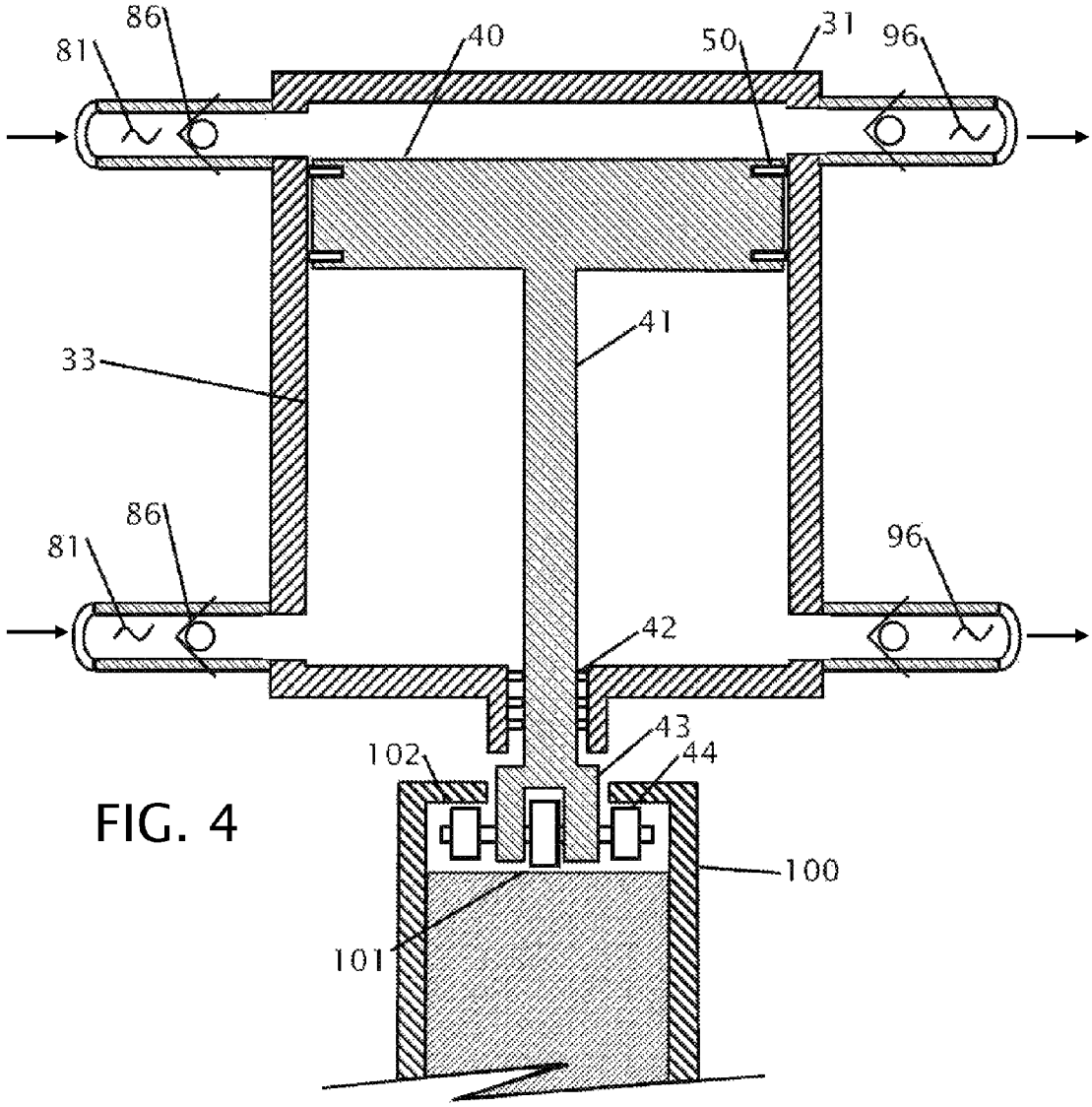

FIG. 4 shows a cut-away view of the dual chamber cylinder, compressor Type IV.

Figure 5:
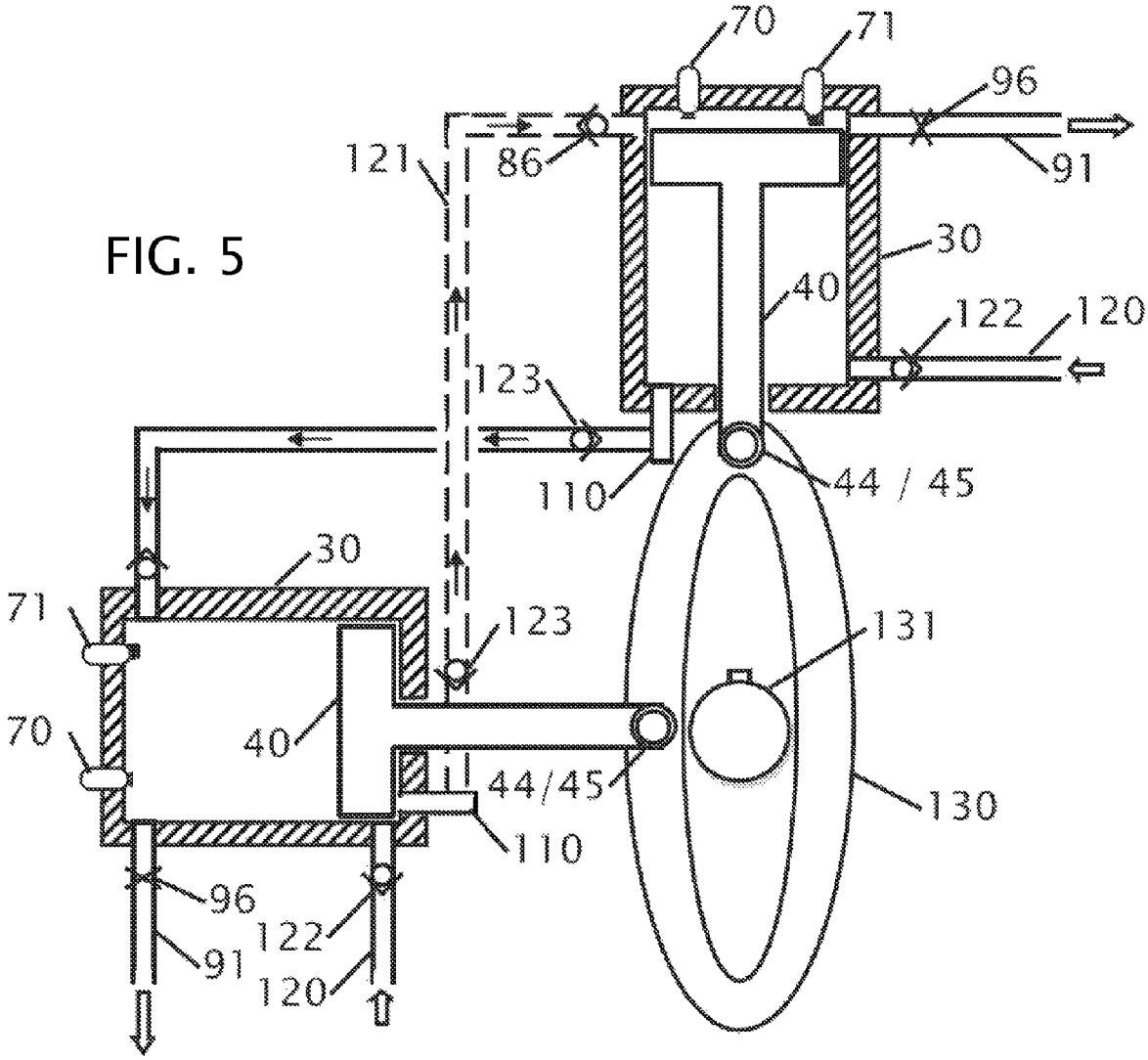

FIG. 5 shows a block diagram of the operation of the two-cylinder/two-stroke engine.

Figure 6:
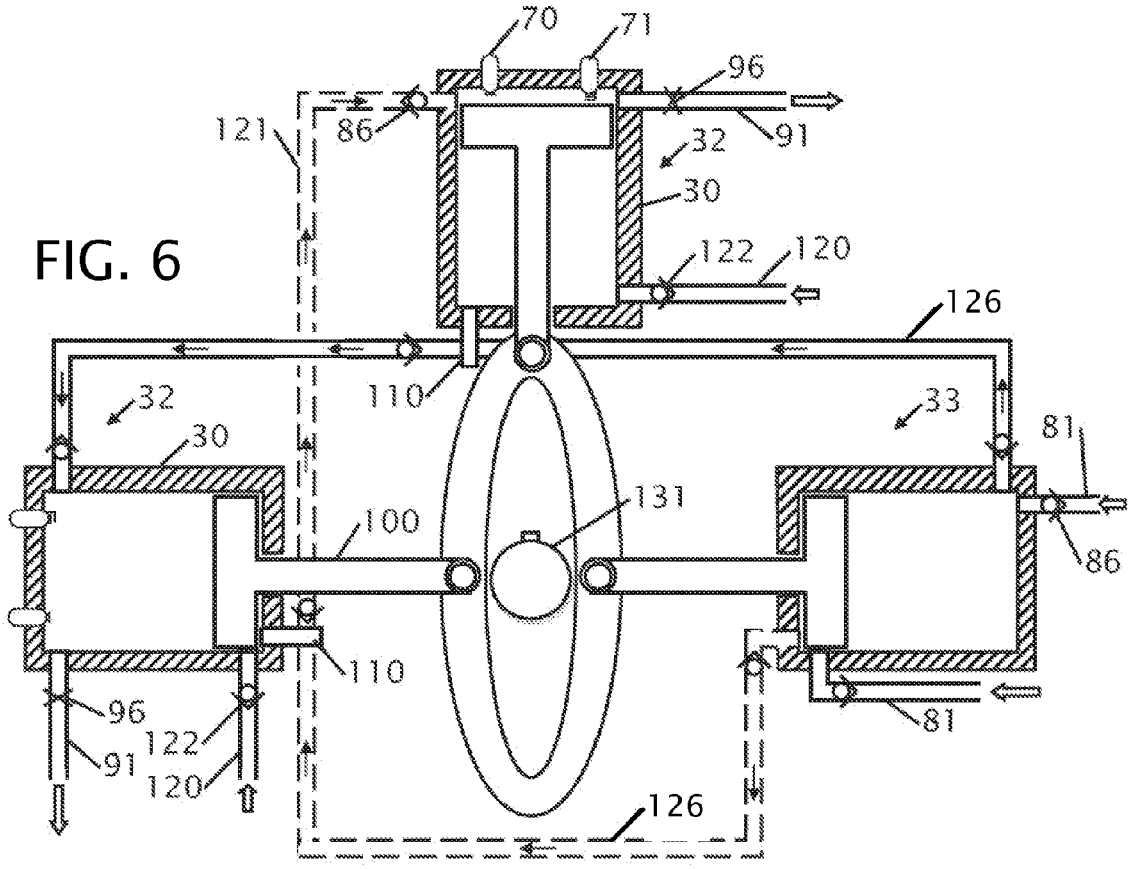

FIG. 6 shows a block diagram of two-cylinder, two-stroke engine with a supercharger cylinder.

Figure 7:
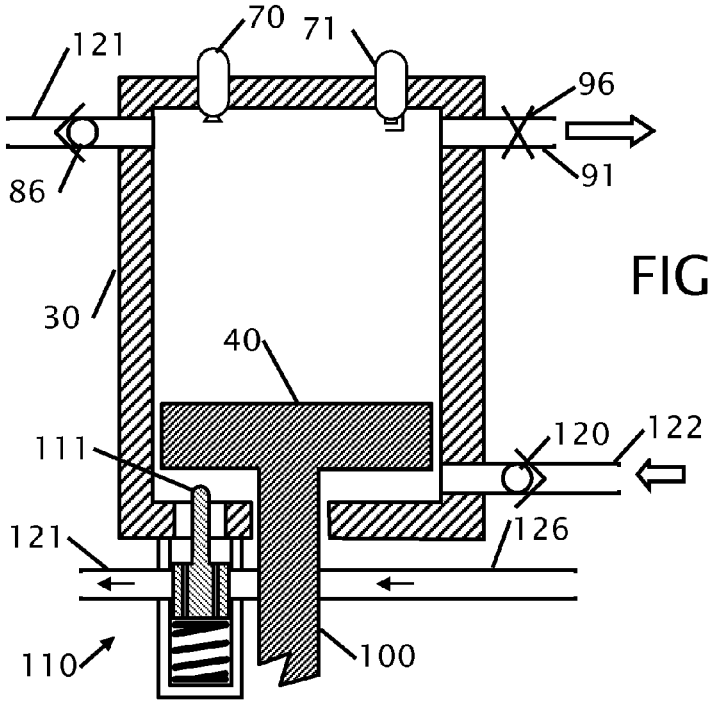

FIG. 7 shows a dual chamber cylinder for a two-stroke engine with a piston valve.

Figure 8:
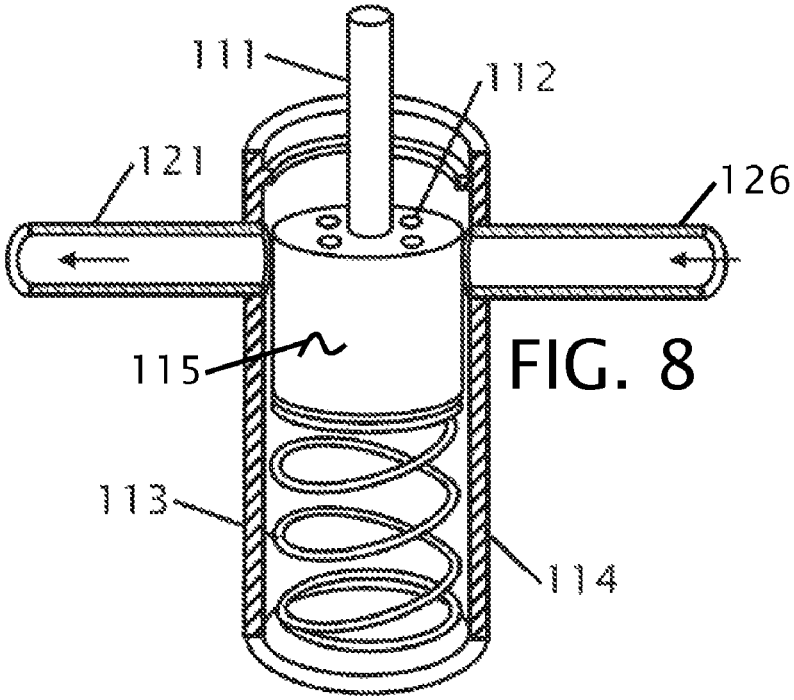

FIG. 8 shows a detail view of a piston valve used in a two-stroke engine.

Figure 9:
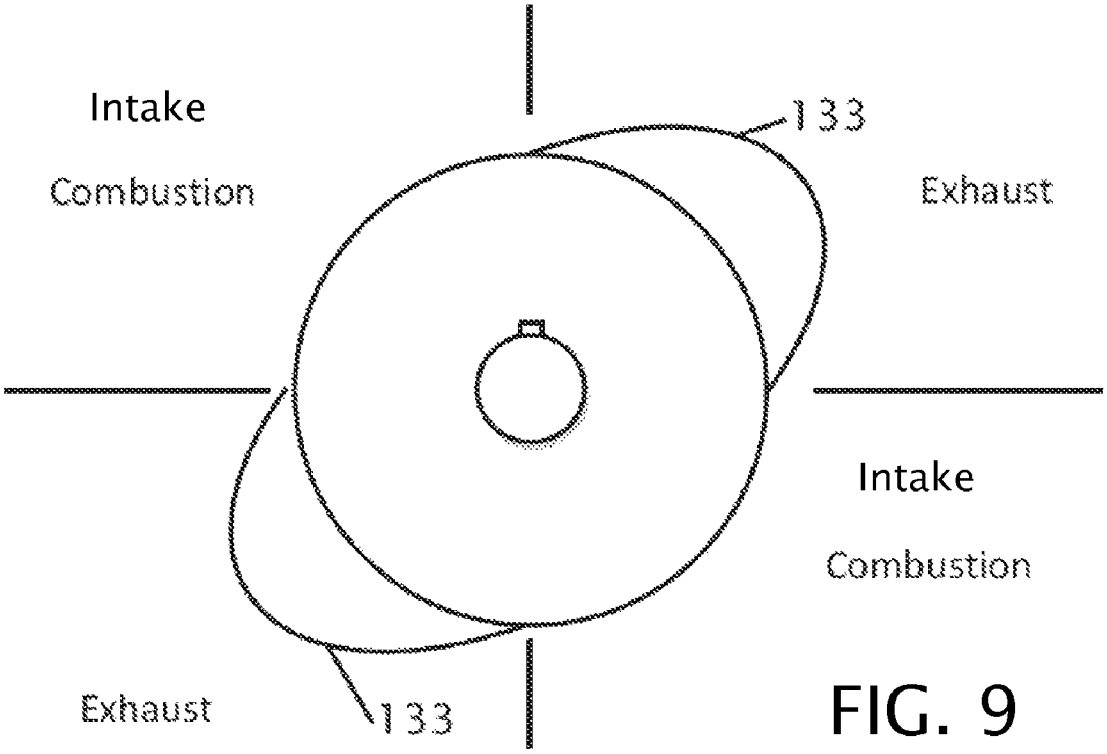

FIG. 9 shows a cam lobe(s) for an exhaust valve for a two-stroke engine.

Figure 10:
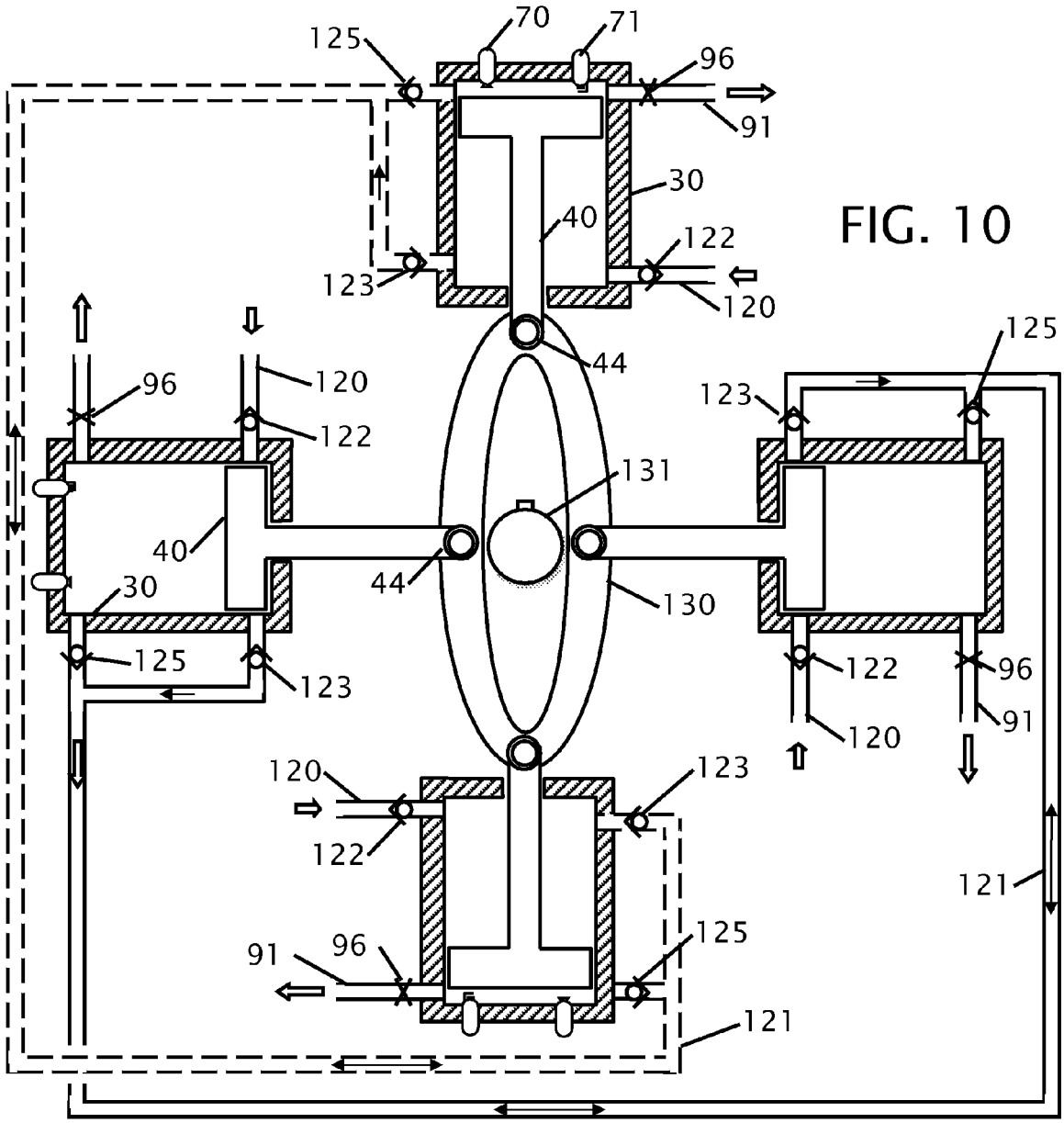

FIG. 10 shows a block diagram of a four cylinder-four cycle engine four stroke engine.

Figure 11:
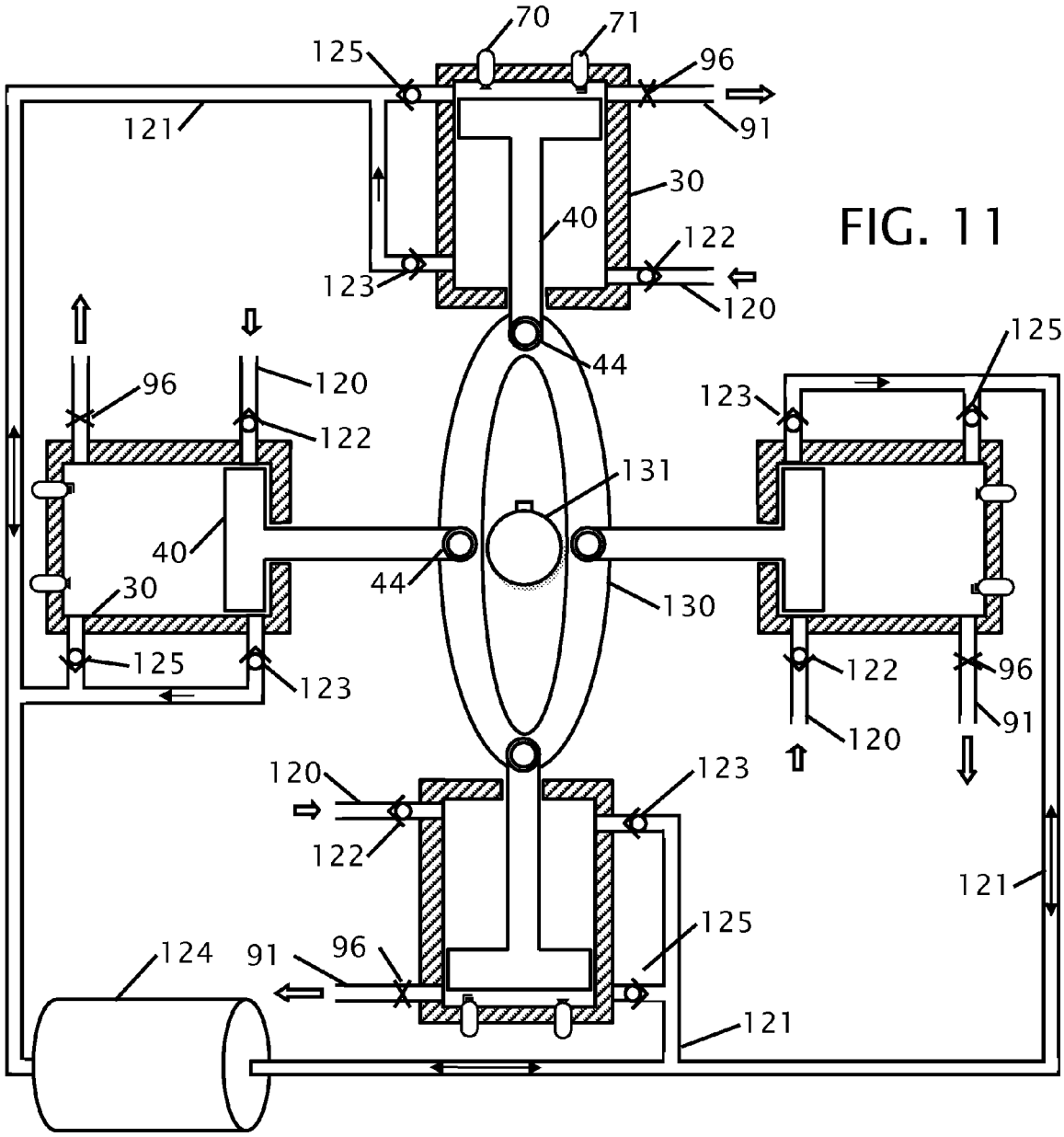

FIG. 11 shows a block diagram of a four cylinder-four cycle engine with an air storage tank.

Figure 12:
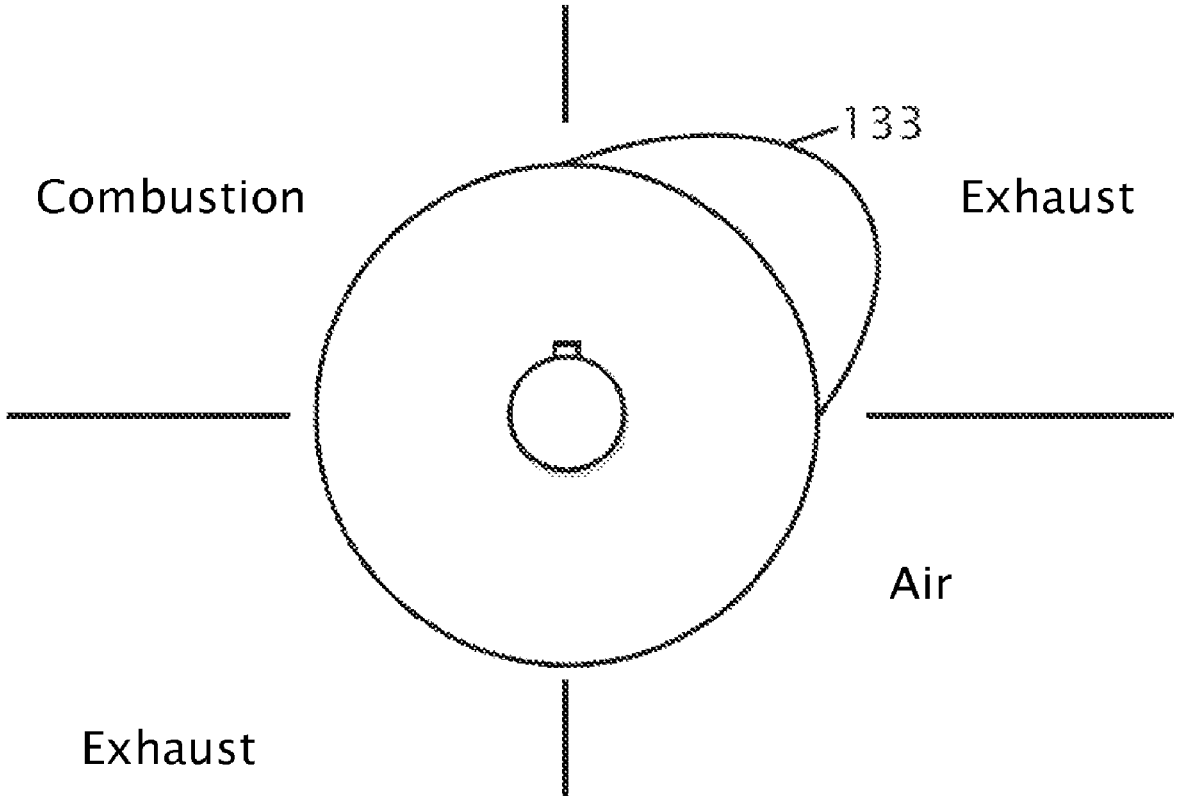

FIG. 12 shows a cam lobe for an exhaust valve of a four-stroke engine.

Figure 13:
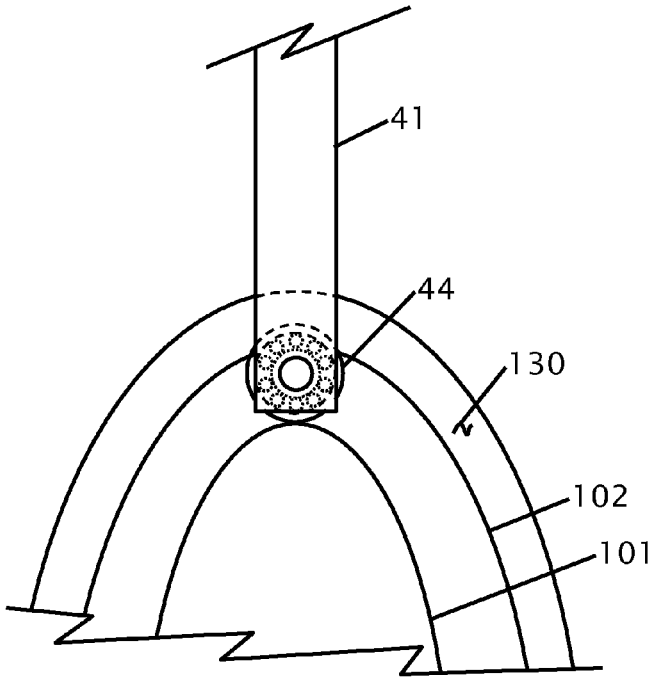

FIG. 13 shows a first preferred embodiment of a piston rod connected to an elliptical shaft.

Figure 14:
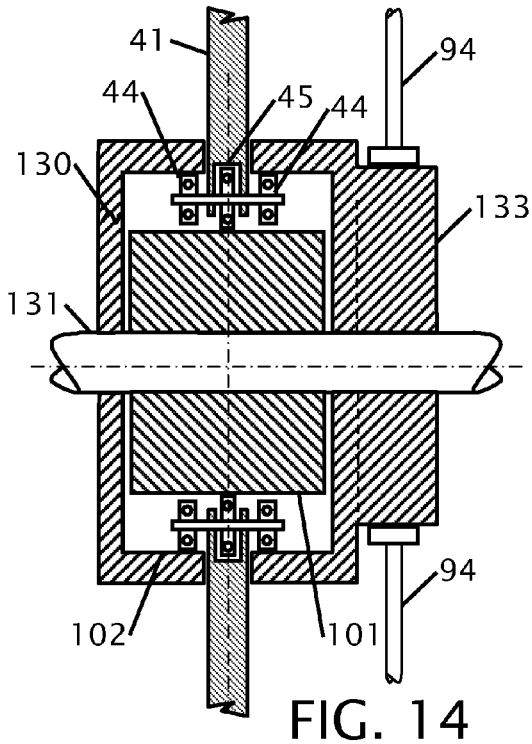

FIG. 14 shows a cross sectional view of the piston rod, elliptical shaft and a cam lobe for exhaust valves for the Type I and Type II engines.

Figure 15:
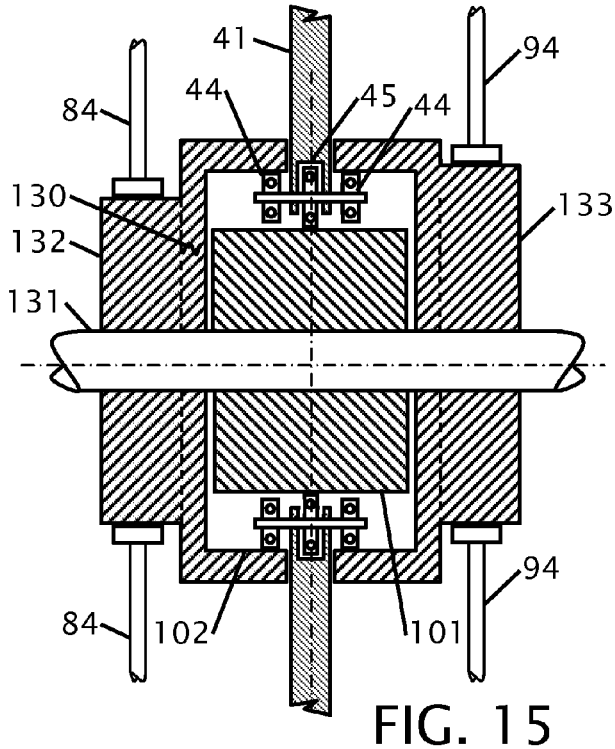

FIG. 15 shows a cross sectional view of the piston rod, elliptical shaft and a cam lobe for an air valve and a cam lobe for an exhaust valve for a Type III engine.

Figure 16:
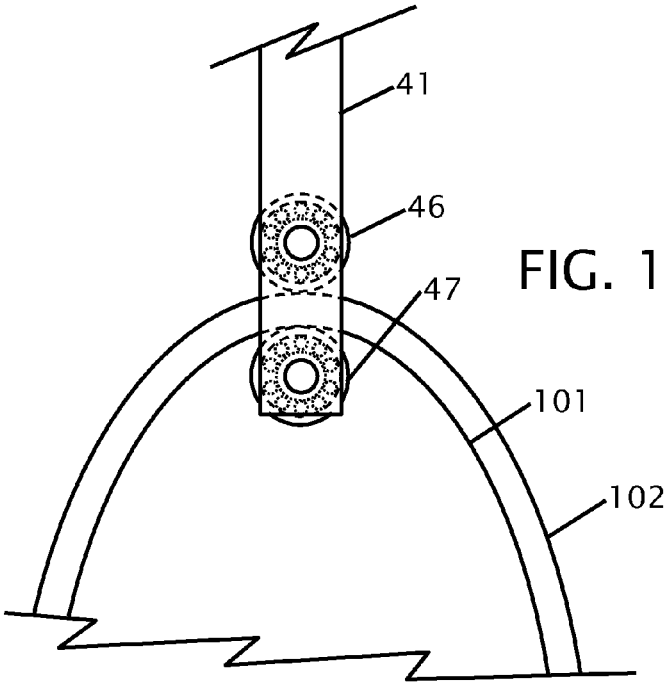

FIG. 16 shows a second preferred embodiment of a piston rod connected to an elliptical shaft.

Figure 17:
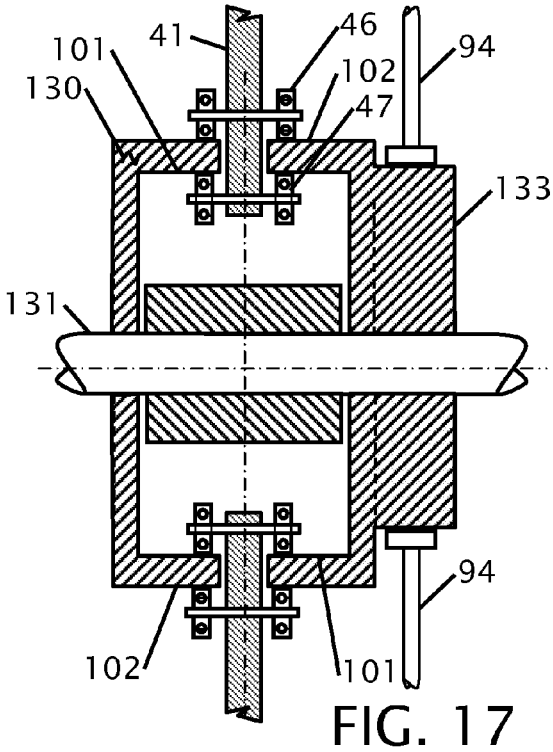

FIG. 17 shows a cross sectional view of the piston rod, elliptical shaft and a cam lobe for exhaust valves for the Type I and Type II engines.

Figure 18:
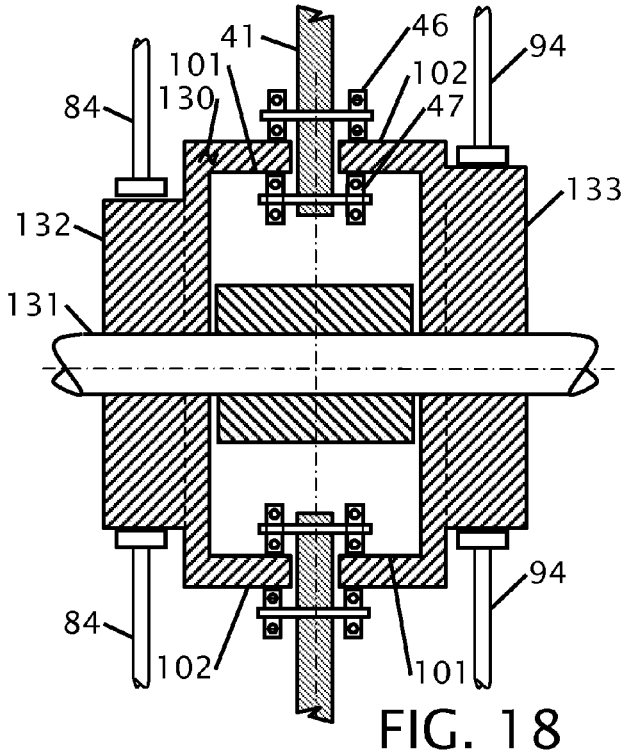

FIG. 18 shows a cross sectional view of the piston rod, elliptical shaft and a cam lobe for an air valve and a cam lobe for an exhaust valve for a Type III engine.

Figure 19:
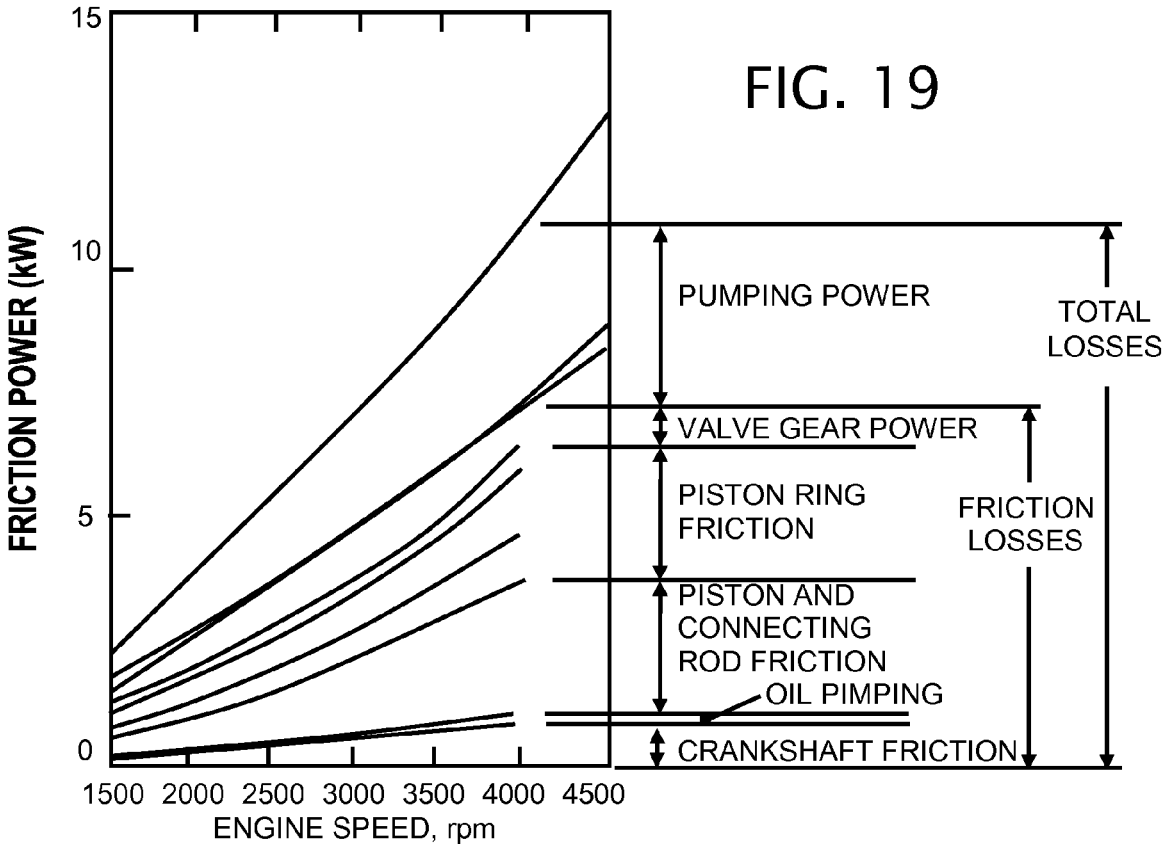

FIG. 19 shows a graph of where power is consumed in a typical four-stroke engine at various engine speeds.

Figure 20:
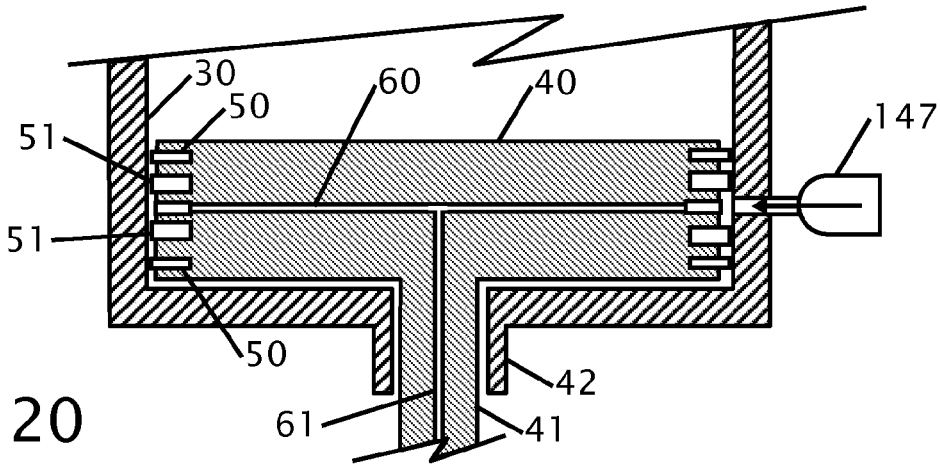

FIG. 20 shows a cut-away view of an oil injection system using an injector that is similar to a fuel injector.

Figure 21:
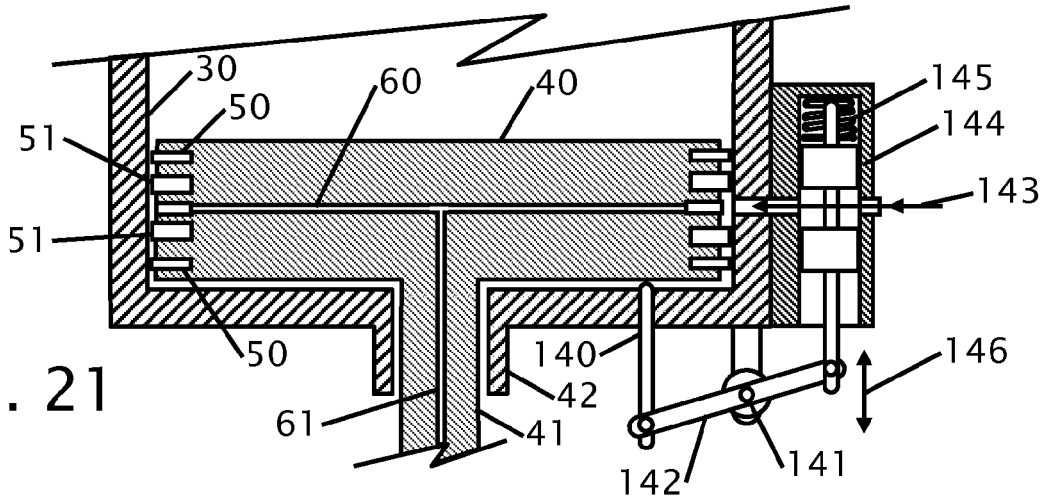

FIG. 21 shows a cut-away view of an oil injection system using an injector with the spool valve in the open position.

Figure 22:
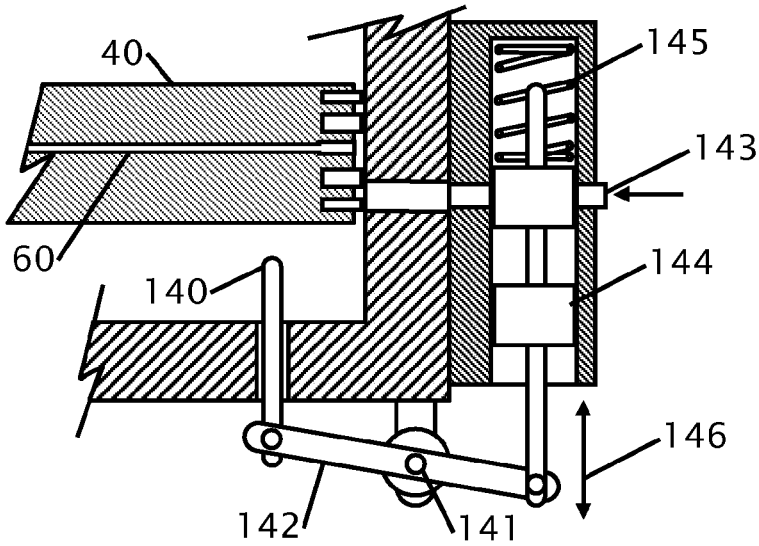

FIG. 22 shows a cut-away view of an oil injection system using an injector with the spool valve in the closed position.

Figure 23:
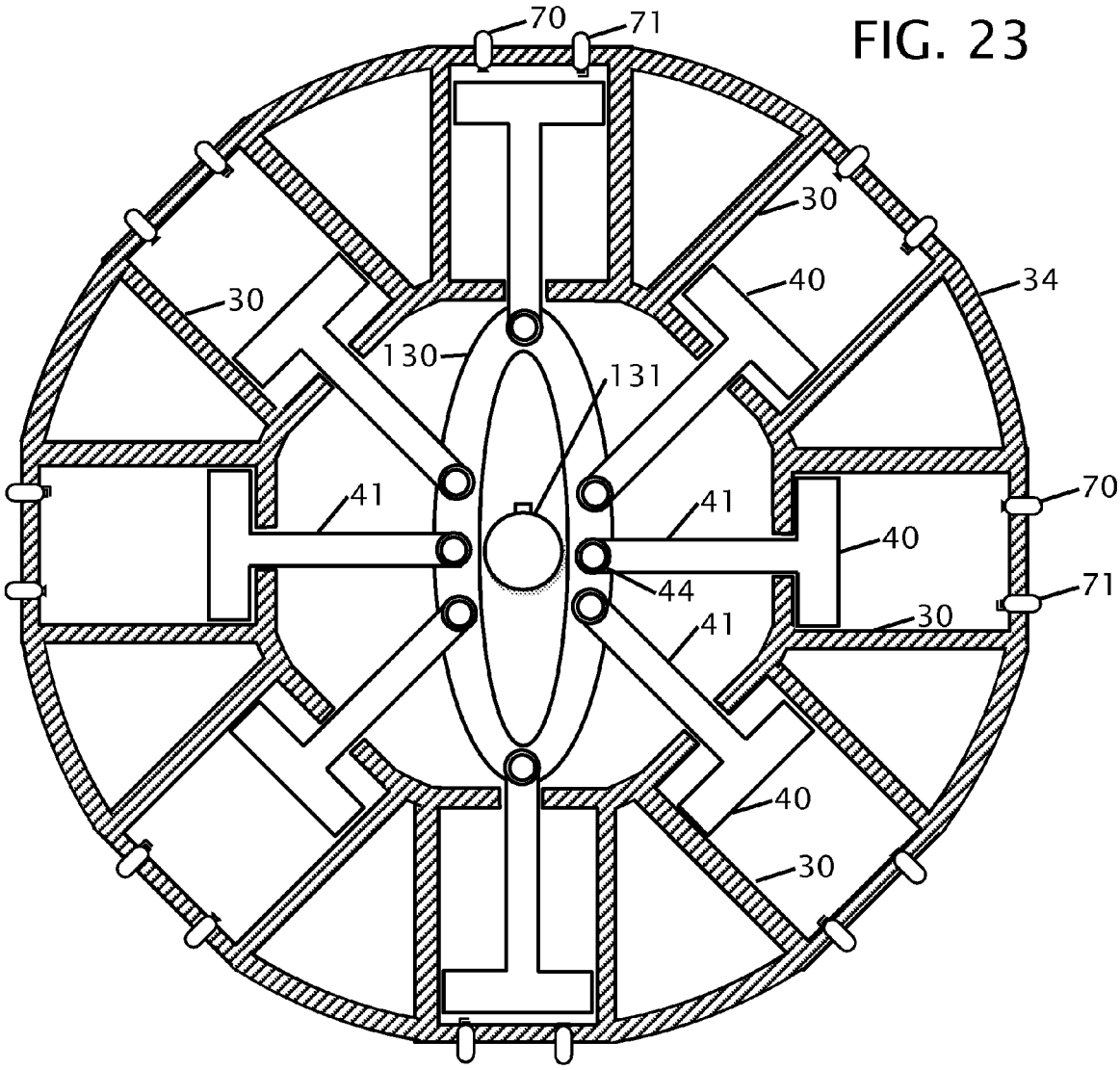

FIG. 23 shows a simplified cross sectional view of the engine with eight cylinders on one elliptical crank.

DETAILED DESCRIPTION OF THE INVENTION

The engine/compressor can be one of four types. Type I is a two-stroke engine, Type II is a four-stroke engine with supercharger, Type III is a four-stroke engine without supercharger and Type IV is a compressor cylinder. The figures show various spaces above and below the pistons. These spaces are for the purposes of illustration only and change based upon the design requirements. In general the spacing above a piston is greater than the spacing below the piston for clearance of a spark plug, air movement and or fuel injection.

Figure 1:
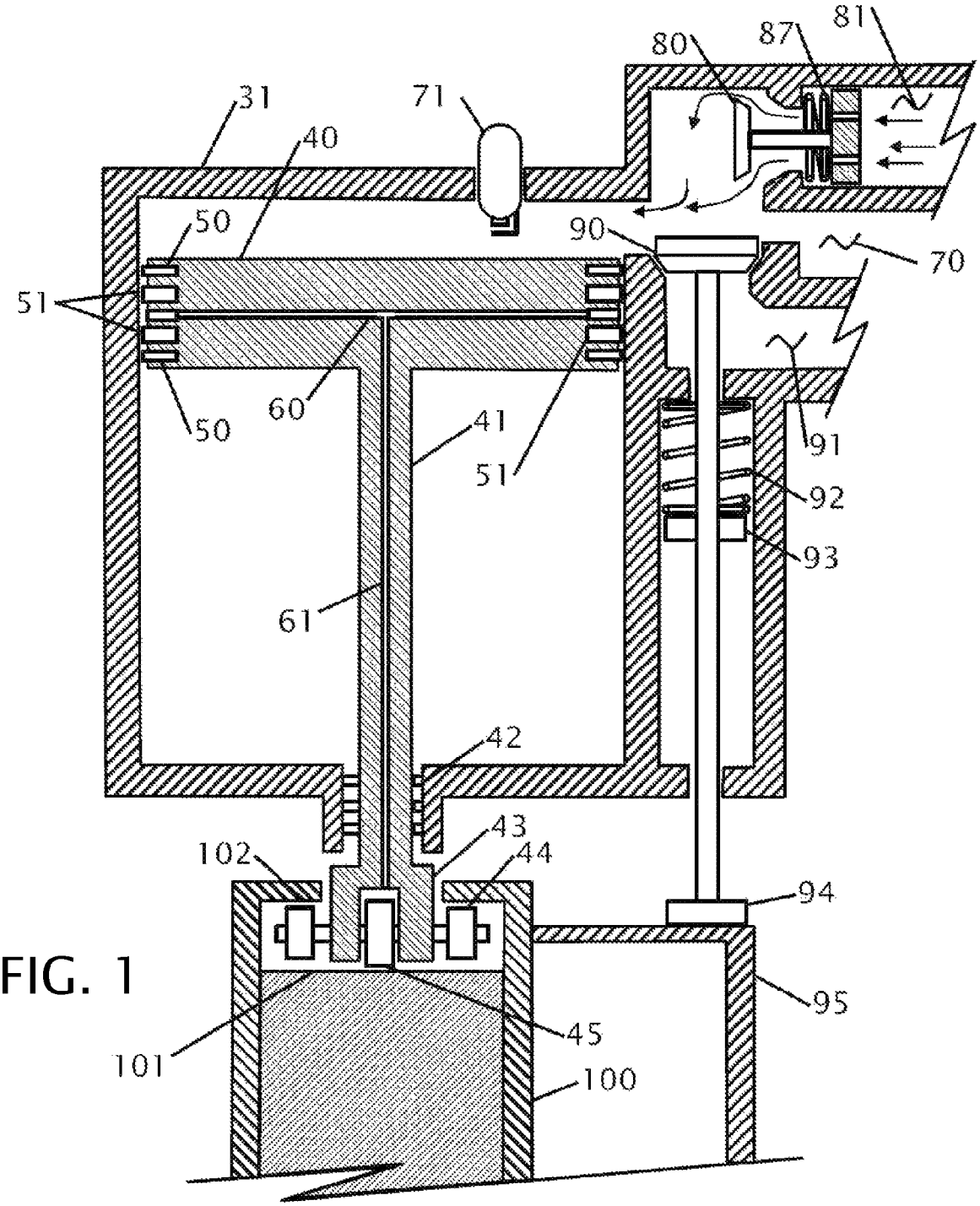
FIG. 1 shows a cut-away view of a first preferred embodiment of the dual chamber cylinder Type I and Type II at air pressure intake.
Figure 2:
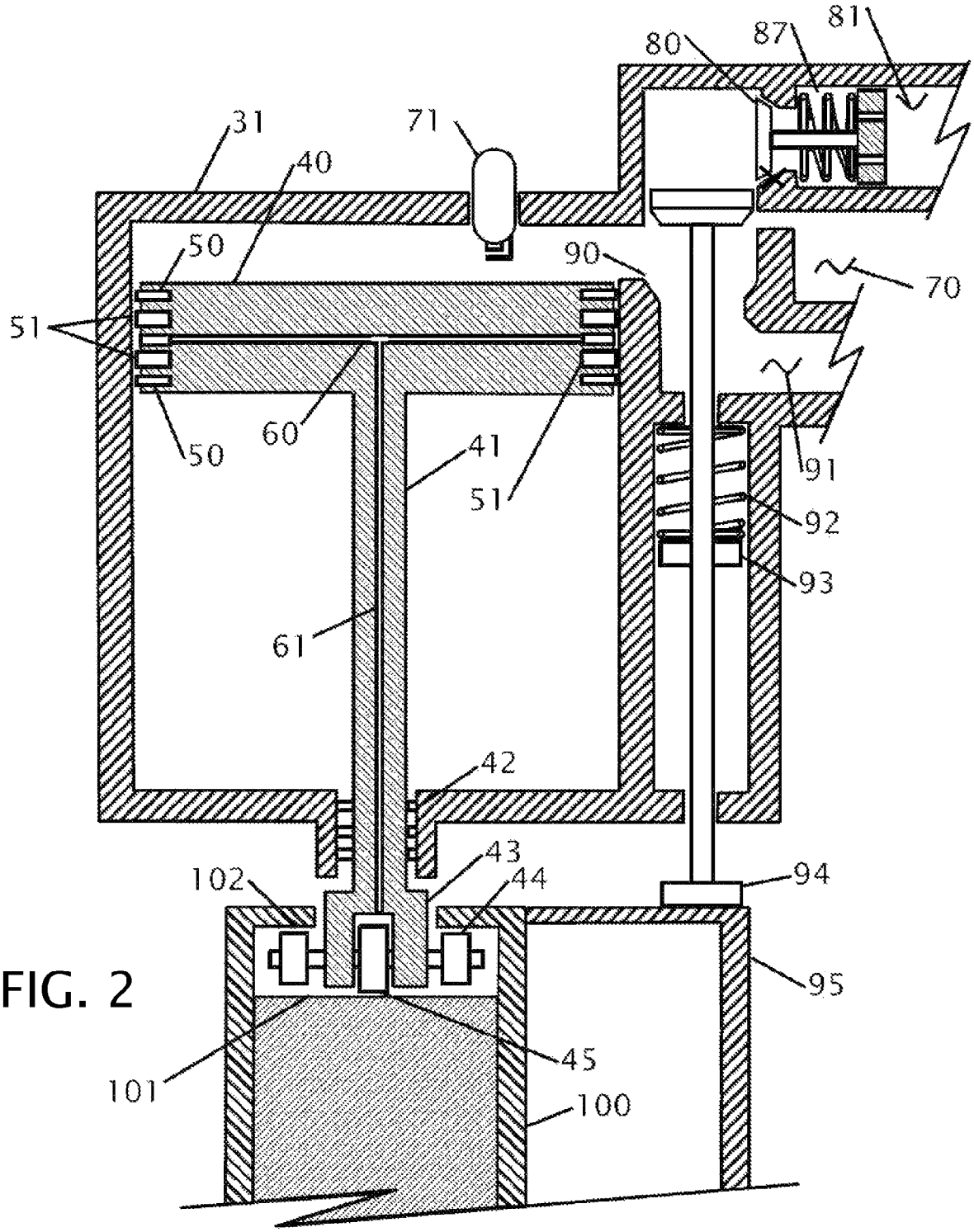
FIG. 2 shows a cut-away view of the first preferred embodiment of the dual chamber cylinder Type I and Type II at exhaust.

FIGS. 1 and 2 show cut-away views of a preferred embodiment of the dual chamber cylinder. An internal combustion engine has one or more cylinders 30 where each cylinder 30 is divided by a piston 40 into an upper and lower chamber. The piston(s) 40 slide with reciprocating rectilinear motion inside the cylinder 30 with a piston rod or arm 41. The piston rod 41 exists in a fixed orientation to the piston 40 and slides in and out of the cylinder through a guided tube with seal 42 in the end of the cylinder, using low friction seal(s). There are two types of operation for the cylinders. Type I has one chamber for combustion/exhaust and a second chamber for air/compression which is herein called a split-cycle engine or two-stroke engine. The second type uses one chamber for air/compress/combustion/exhaust and a second chamber for air/compression which is herein called a four-cycle engine with supercharger.

The piston rod 41 will slide in and out of the cylinder through a guided tube in one end of the cylinder using a low friction seal 42. The piston, which can slide with reciprocating rectilinear motion inside the cylinder between a bottom dead center (BDC) and top dead center (TDC) a device such as an ellipse shaft converts the reciprocating rectilinear motion of the piston into rotary motion of the engine shaft. The piston arm 41 movement distance between the bottom dead center (BDC) and the top dead center (TDC) is equal to a half difference of the major axis and the minor axis of the ellipse shaft and each shafting will turn the engine shaft at 90 degrees rather than 180 degrees as in an existing engine. The ellipse or elliptical crank 100 shaft has two walls, an inside wall 101 to push the piston rod into the cylinder and an outside wall 102 to pull out the piston rod out of the cylinder. The ellipse or elliptical crank is shown and described in more detail with FIGS. 13-18 herein. The piston rod or arm 41 terminates in a piston arm guide 43 with two roller set against the outside wall 102 and the second roller bearings 45 set against the inside wall 101.

A head 31 closes the top of the cylinder 30. The head 31 includes provisions for a fuel injector 70 for supplying fuel into the air stream of the intake and a spark plug 71 to ignite a compressed gas/air mixture with the cylinder 30. Air enters into the cylinder from the intake port where air 81 comes in 80 through an intake check valve. Exhaust air 91 exits the cylinder from the exhaust port where exhaust air 91 comes through the exhaust valve 90. The exhaust valve 90 is held closed by an exhaust valve spring 92 that pushes on an opposing exhaust valve spring stop 93. The exhaust valve 90 has an exhaust valve lifter 94 that is lifted with an exhaust cam lobe 95 located on the crank 100.

The piston 40 seals against the inside of the cylinder 30 with a series of compression 50 and oil rings 51. An oil tube or pipe 60 and an oil drain 61 moved oil out the piston. The oil passage into the oil pipe 60 is shown and described in more detail with FIGS. 20, 21 and 22. Because oil enters in the middle of the piston 40 there are oil rings 50 on both sides of the oil pipe 60 with compression rings 50 near the outer surfaces of the piston 40.

FIG. 3 show cut-away views of a Type III engine according to a first preferred embodiment of the one chamber cylinder. An internal combustion engine has one or more cylinders 30 where each cylinder 30 is divided by a piston 40 into an upper and lower chamber. The piston(s) 40 slide with reciprocating rectilinear motion inside the cylinder 30 with a piston rod or arm 41. The piston rod 41 exists in a fixed orientation to the piston 40 and slides in and out of the cylinder through a guided tube or piston arm seal 42 in the end of the cylinder, using low friction seal(s). This Type III uses one chamber for air/compress/combustion/exhaust and the second chamber is open for oil passage 62 which is herein called a four-cycle engine.

The piston rod 41 will slide in and out of the cylinder through a guided tube in one end of the cylinder using a low friction seal 42. The piston, which can slide with reciprocating rectilinear motion inside the cylinder between a bottom dead center (BDC) and top dead center (TDC) a device such as an ellipse shaft converts the reciprocating rectilinear motion of the piston into rotary motion of the engine shaft. The piston arm 41 movement distance between the bottom dead center (BDC) and the top dead center (TDC) is equal to a half difference of the major axis and the minor axis of the ellipse shaft and each shafting will turn the engine shaft at 90 degrees rather than 180 degrees as in an existing engine. The ellipse or elliptical crank 100 shaft has two walls, an inside wall 101 to push the piston rod into the cylinder and an outside wall 102 to pull out the piston rod out of the cylinder. The ellipse or elliptical crank is shown and described in more detail with FIGS. 13-18 herein. The piston rod or arm 41 terminates in a piston arm guide 43 with two roller bearings 44. One set of roller bearings is set against the outside wall 102 and the second set of roller bearings is set against the inside wall 101.

A head 31 closes the top of the cylinder 30. The head 31 includes provisions for a fuel injector 70 for supplying fuel into the air stream of the intake and a spark plug 71 to ignite a compressed gas/air mixture with the cylinder 30. Air enters into the cylinder from the intake port where air 81 comes in 80 through an intake valve 80. The air that enters from the intake valve 80. The intake valve is held closed by an intake valve spring 82 that pushes on an opposing intake valve spring stop 83. The intake valve 80 has an intake valve lifter 84 that is lifted with an intake cam lobe 85 located before the crank 100. Exhaust air 91 exits the cylinder from the exhaust port where exhaust air 91 comes through the exhaust valve 90. The exhaust valve 90 is held closed by an exhaust valve spring 92 that pushes on an opposing exhaust valve spring stop 93. The exhaust valve 90 has an exhaust valve lifter 94 that is lifted with an exhaust cam lobe 95 located after the crank 100.

FIG. 4 show cut-away views of a preferred embodiment of the dual chamber cylinder. An internal combustion engine has one or more air pump cylinders 33 where each cylinder 33 is divided by a piston 40 into an upper and lower chamber. The piston(s) 40 slide with reciprocating rectilinear motion inside the cylinder 30 with a piston rod or arm 41. The piston rod 41 exists in a fixed orientation to the piston 40 and slides in and out of the cylinder through a guided tube or piston arm seal 42 in the end of the cylinder, using low friction seal(s). This version uses two chambers for air/compression which are herein called a compressor or Type IV.

The piston rod 41 will slide in and out of the cylinder through a guided tube in one end of the cylinder using a low friction seal 42. The piston, which can slide with reciprocating rectilinear motion inside the cylinder between a bottom dead center (BDC) and top dead center (TDC) a device such as an ellipse shaft converts the reciprocating rectilinear motion of the piston into rotary motion of tan engine shaft. The piston arm 41 movement distance between the bottom dead center (BDC) and the top dead center (TDC) is equal to a half difference of the major axis and the minor axis of the ellipse shaft and each shafting will turn the engine shaft at 90 degrees rather than 180 degrees as in an existing engine. The ellipse or elliptical crank 100 shaft has two walls, an inside 101 wall to push the piston rod into the cylinder and an outside wall 102 to pull out the piston rod out of the cylinder. The ellipse or elliptical crank is shown and described in more detail with FIGS. 13-18 herein. The piston rod or arm 41 terminates in a piston arm guide 43 with two roller bearings 44. One set of roller bearings is set against the outside 102 wall and the second set of roller bearings is set against the inside wall 101. The each chamber of cylinder 33 has one air intake check valve 86 and one compressed air outlet check valve 96.

Two-Stroke Engine/Split Cycle Engine

FIG. 5 shows a block diagram of two cylinders acting as a four cylinder engine. This is accomplished by using the downward stroke of the first cylinder to generate power for the engine and at the same time compresses the air in the lower chamber to use in the second cylinder. The downward stroke of the second cylinder generates power for the engine and compresses air for the first cylinder. The components of these cylinders is the same or similar to the components shown and described in FIG. 1. The air valve 110 shown in FIG. 8, and the cam lobe(s) have exhaust lobes 133.

A fuel injector 70 and a spark plug 71 exist on the top or head of the cylinder. On the up stroke of a piston 40 atmospheric air 120 is brought into the underside of the cylinder 30 through a one-way check valve 122. When the piston 40 goes down the air within the cylinder is compressed and passes through a piston actuated valve 110 and through a one way check valve 123 where the pressurized air line 121 pushes the compressed air into the top of a piston though one-way check valve 86 where it is mixed with injected fuel from the fuel injector 70 and detonated with the spark plug 71. The piston 40 is then driven down with the expanding gas. The piston 40 then moves up and expel the burnt exhaust through valve 96 and out the exhaust port 91.

FIG. 6 is the same as FIG. 5 except for the addition of one compressor cylinder for the system to act as a supercharger. The components and functions of FIG. 6 is the same as FIG. 5. The compressor 33 pushes the compressed air through line 126 and then through the piston valve 110 to the cylinder 32. From FIG. 6, both strokes of the air pump cylinder 33 bring in air from the outside into air lines 81 through one way valves 86. The air within the pressurized air line 126 is also increased by the downward stroke of the work cylinders 32.

The engine in FIG. 7 has a fuel injector 70 and a spark plug 71. The cylinder 30 has a pressurized air line 121 with a one-way intake check valve 86 and an exhaust valve 96 where the burned exhaust exits out the exhaust port 91. In the lower portion of the cylinder air is brought into 120 the underside of the piston 40 through one-way valve 122 as the piston moves up in the cylinder 30. When the piston 40 moves down the air under the piston 40 is compressed and exits the bottom of the cylinder 30 only when the underside of the piston 40 depresses the stem 111 of the piston actuated valve 110. The piston actuated valve 110.

FIG. 8 has a stopper piston 115 that blocks the compressed air from line 126 and from the same cylinder and blocks outlet line 121. The piston has vent holes 112 to allow the pressure to equalize the pressure in the upper and lower portions of the stopper piston 115. The piston is held in a closed position by spring 113. When the underside of piston cylinder 40 pushes down on the stem 111 the spring force in overcome and the stopper piston 115 is pushed down thereby allowing flow from line 126 and from the bottom of the cylinder to go through line 121 to the other cylinders. The spring 113 and the stopper piston 115 are maintained in a housing 114 that seals the pressurized air line 121 and the pressurized line 126.

FIG. 9 shows the cam lobes 133 for the left exhaust valve for the two-stroke engine.

Four-Stroke Engine

FIG. 10 shows a block diagram of a four cylinder-four cycle engine. FIG. 11 shows a block diagram of a four cylinder-four cycle engine with air storage tank. The components of these cylinders is similar to previous described with the cylinder(s) 30 having an internal piston 40 connected to a fixed piston arm through a bearing 44 to an elliptical crank 130 that turns drive shaft 131. A fuel injector 70 and a spark plug 71 exist on the top or head of the cylinder. On the up stroke of a piston 40 atmospheric air 120 is brought into the underside of the cylinder 30 through a one-way check valve 122. When the piston 40 goes down the air within the two cylinders is compressed and passes through a one way check valve 123 where the pressurized air line 121 pushes the compressed air into the top of a piston though check valve 125 where it is mixed with injected fuel from the fuel injector 70 and detonated with the spark plug 71. The piston 40 is then driven down with the expanding gas. The piston 40 then moves up and expel the burnt exhaust through valve 96 and out the exhaust port 91. In FIG. 11 a storage tank 124 is used to store the pressurized air from the down strokes of the pistons. Alternately it is contemplated that upon the down stroke the air under the piston can pass through a one-way valve within the piston to the top side of the piston. The component of these cylinders is the same or similar to the components shown and described in FIGS. 1 and 2.

FIG. 12 shows a cam lobe 133 for the exhaust valves lifter for a four-stroke engine.

FIG. 13 shows a first preferred embodiment of a piston rod 41 connected to an elliptical shaft 130. FIG. 14 shows a cross sectional view of the piston rod and elliptical crank with cam lobes 133 for exhaust lifter valves 94 and FIG. 15 shows a cross sectional view of piston rod 43 and elliptical crank 130 with two cam lobes 132 for intake air valves. Cam lobes 133 are used for operating exhaust valves. The piston rod 41 is supported on three bearings 44 and 45. Bearing 45 rolls on the inside wall 101 and bearings 44 roll on the outside walls 102. Bearing 45 is called a push bearing and bearings 44 are called pull bearings.

FIG. 16 shows a second preferred embodiment of a piston rod 41 connected to an elliptical shaft 130. FIG. 17 shows a cross sectional view of the piston rod and elliptical crank with cam lobes 133 for exhaust lifter valves 94 and FIG. 18 shows a cross sectional view of piston rod 43 and elliptical crank 130 with two cam lobes 132 for intake air valves. Cam lobes 133 are used for operating exhaust valves. The piston rod 41 is supported on four bearings 46 and 47. Bearing 47 rolls on the inside wall 101 and bearings 46 roll on the outside walls 102. Top bearing 46 is called a push bearing and bottom bearings 47 are called pull bearings.

FIG. 19 shows a graph of where power is consumed in a typical four stroke engine at various engine speeds. From this graph the crankshaft friction, piston and connecting rod friction oil pumping, piston ring friction, valve gear power and the pumping power are shown at engine speeds of 1,500 to about 4,000 rpm. In the disclosed design the drive mechanism for the valve cam is eliminated because the valves are moved with lobes on the same shaft of the crank shaft. Frictions from angular rotation of the piston on the piston arm and piston side drag on the cylinder walls are also eliminated. The aerodynamic drag under the piston is also eliminated (not shown in this graph).

FIGS. 20-22 show cut-away views of an oil injection system. About two-thirds of an engine friction occurs in the piston and rings, and two-thirds of this is friction at the piston rings. All friction that occurs due to side-to-side force is eliminated because there are no side forces in the proposed design, therefore there are three alternatives of lubrication. In the first preferred embodiment, oil is injected in a method similar to fuel being injected into the cylinders as shown in FIG. 20. The second preferred embodiment is with oil being injected through an oil valve shown in FIGS. 21 and 22.

In FIG. 20 shows the first preferred embodiment of a cut-away view of an oil injection system using an injector that is similar to a fuel injector. In this figure the oil injector 147 injects oil into the oil pipe 60 when the piston 40 is at or near the bottom of the stroke.

FIGS. 21-22 show second preferred embodiment a oil valve 144 is used to force oil onto the piston rings between the two oil rings 51 that will inject or pump oil when the piston 40 reaches the bottom of the cylinder 30 when the oil is channeled into the piston 40 and then goes into an oil pipe 60 then into the oil or into the piston rod 41. The oil will then drain through the oil drain 61 and then goes over the roller and then into a sump pump. The piston has two compression rings 50 and two oil rings 51 and one oil channel 61 and an oil pipe 60.

From the detail shown in FIGS. 21 and 22, when the piston 40 reaches near the bottom of the stroke the bottom of the piston 40 will make contact with a stem 140 that is linked through an arm 142 on a pivot 141. The arm will lift 146 the valve 144 where oil will then be injected 143 through the cylinder 30 wall into the oil pipe 60. A spring 145 maintains the injector 143 in a closed orientation until the piston 40 and oil injector 143 are sufficiently aligned at the bottom of the stroke.

A third alternative is to lubrication using a fuel and oil mixture that is commonly used with two stroke engines.

FIG. 23 shows a simplified cross sectional view of the engine with eight cylinders on an elliptical crank. The components of these cylinders is similar to previous described with the cylinder(s) 30 having an internal piston 40 connected to a fixed piston arm through a bearing 44 to an elliptical crank 130 that turns drive shaft 131. A fuel injector 70 and a spark plug 71 exist on the top or head of the cylinder. Each piston 40 has a piston arm 41 that connects through a bearing onto the elliptical crank 130 that turns the drive shaft 131. The cylinders could be various types of mixed cylinders selected between engine cylinders and compression cylinders based upon desire, need or use.

Thus, specific embodiments of a dual chamber cylinder engine have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A dual chamber cylinder engine/compressor comprising:

a housing having a first cylindrical cavity and at least a second cylindrical cavity each said cylinder cavity has a piston that divides each said cylindrical cavities into an upper chamber and a lower chamber;

at least one head on top of said upper cylindrical chamber for enclosing a said cylindrical chambers;

each piston each having piston rods extending in a fixed perpendicular orientation from a bottom of each piston;

a low friction seal located on a bottom of each of said cylinders to allow sealed constrained linear movement of said piston rod(s);

said separate piston rods are secured to an elliptical shaft to convert reciprocating rectilinear motion into rotary motion;

an inlet and an inlet check valve on each of said lower chamber cylindrical cavities for bringing air into said lower chamber when said pistons are on an up stroke;

an outlet and an outlet check valve on said lower chamber cylindrical cavities wherein compressed air is pushed out through said outlet and outlet check valve when said pistons are on a down stroke;

said compressed air from a first lower chamber is transferred to a first upper chamber of the same and or a separate cylindrical cavity (ies);

at least one spark plug and at least one fuel injector located in said head, and wherein said compressed air is used to supercharge said engine.

2. The dual chamber cylinder engine/compressor according to claim 1 that further includes an exhaust valve that is operable from an exhaust lobe located on an output shaft.

3. The dual chamber cylinder engine/compressor according to claim 2 wherein said exhaust lobe can operate more than one exhaust valve.

4. The dual chamber cylinder engine/compressor according to claim 1 that further includes an air storage tank for storing compressed air that is from a said upper or said lower chamber(s).

5. The dual chamber cylinder engine/compressor according to claim 1 that further includes an oil application mechanism that injects oil into a circumference of said piston between piston rings.

6. The dual chamber cylinder engine/compressor according to claim 1 that further includes at least one intake check valve located in said head.

7. The dual chamber cylinder engine/compressor according to claim 1 that further includes an intake valve that is operable from an intake lobe located on an output shaft.

8. The dual chamber cylinder engine/compressor according to claim 7 wherein said intake lobe can operate more than one intake valve.

9. The dual chamber cylinder engine/compressor according to claim 1 that further includes an second inlet and a second inlet check valve on said upper chamber for bringing air into said upper chamber when a piston is on a down stroke, a second outlet and a second outlet check valve on said upper chamber wherein compressed air is pushed out through said second outlet and said second outlet check valve from above said piston is on a up stroke, and is transferred to a upper chamber of a separate cylindrical cavity(ies) or to an air storage tank.

10. The dual chamber cylinder engine/compressor according to claim 1 that further includes a piston valve that is held closed by a spring that is operated by said underside of said lower chamber of at least one of said at least one piston(s) cylinder that presses on a stem thereby opening said piston valve to allow compressed air to flow from under said lower chamber of said at least one piston into a pressurized air line for use in an upper chamber of another cylinder and said piston valve includes vent holes that allows equalization of pressure above and below said piston valve.

11. The dual chamber cylinder engine/compressor according to claim 9 wherein said engine/compressor is used as a compressor for air or fluid.

12. A single chamber cylinder engine comprising:

a housing having a first cylindrical cavity for at least one piston;

at least one head on top of said at least one cylindrical chamber for enclosing a top of said at least one cylindrical chamber;

said at least one piston has a piston rod extending in a fixed perpendicular orientation from a bottom of said at least one piston;

a low friction seal located on the bottom of said first cylindrical cavity to allow sealed constrained linear movement of said piston rod;

said piston rod is secured to an elliptical shaft to convert reciprocating rectilinear motion into rotary motion;

an exhaust valve that is operable from an exhaust lobe located on an output shaft;

at least one spark plug and at least one fuel injector located in said head, and an intake valve that is operable from an intake lobe located on said output shaft.

13. The single chamber cylinder engine according to claim 12 wherein said exhaust lobe can operate more than one exhaust valve.

14. The single chamber cylinder engine according to claim 12 wherein said intake lobe can operate more than one intake valve.

15. The single chamber cylinder engine according to claim 12 that further includes a spark plug and a fuel injector located in said head.

16. An elliptical shaft operable engine comprising:

an internal combustion engine having at least one cylinder and at least one piston;

said at least one piston has a piston rod extending in a fixed perpendicular orientation from a bottom of said piston and extending through a low friction seal in the bottom of said at least one cylinder;

said piston operably slides with reciprocating rectilinear motion inside said at least one cylinder;

said separate piston rod is secured to an elliptical, or similar configuration, shaft to convert reciprocating rectilinear motion into rotary motion between a bottom dead center location and a top dead center location;

said piston rod is secured to an elliptical shaft to convert reciprocating rectilinear motion into rotary motion of an engine shaft;

a distance between said bottom dead center and said top dead center is equal to half of the distance of a major axis and a minor axis of said elliptical shaft and each piston stroke will turn said internal combustion engine at 90 degrees;

said elliptical, or similar configuration, shaft has an inside wall that pushes said at least one piston into said at least one cylinder and an outside wall that pulls said at least one piston out of said at least one cylinder;

said elliptical shaft further having a lobe for operating an exhaust valve and a lobe for operating an intake valve;

said at least one piston rod has bearings that engage said at least one piston rod on said elliptical shaft, and at least one spark plug and at least one fuel injector located in said head.

17. The elliptical shaft device according to claim 16 wherein said intake and said exhaust lobes operate more than one valve each.

18. The elliptical shaft device according to claim 16 that further includes an oil application mechanism that injects oil into a circumference of said piston between piston rings.

* * * * *